United States Patent [19]

Horak et al.

[11] Patent Number: 4,512,053

[45] Date of Patent: Apr. 23, 1985

[54] HAND-HELD SHOE POLISHING APPARATUS

[76] Inventors: Charles F. Horak, 1700 W. Callighan; James M. Jordan, Box 172, both of Fort Stockton, Tex. 79735

[21] Appl. No.: 551,939

[22] Filed: Nov. 15, 1983

[51] Int. Cl.[3] ..... A46B 13/02

[52] U.S. Cl. ..... 15/28

[58] Field of Search ..... 15/28, 29, 97 R, 93 R, 15/23, 24; 51/170 PT, 170 T; 310/50

[56] References Cited

U.S. PATENT DOCUMENTS

| | | | |
|---|---|---|---|
| 3,162,876 | 12/1964 | Aronson et al. | 15/28 |
| 4,202,067 | 5/1980 | Stamatovic | 15/28 |
| 4,299,004 | 11/1981 | Lancaster | 15/28 |
| 4,312,091 | 1/1982 | Cardus | 15/29 |

FOREIGN PATENT DOCUMENTS

| | | | |
|---|---|---|---|
| 1149331 | 7/1957 | France | 15/28 |
| 1218017 | 12/1959 | France | 15/28 |

*Primary Examiner*—Edward L. Roberts

*Attorney, Agent, or Firm*—Norman B. Rainer

[57] ABSTRACT

A hand-holdable apparatus is provided for polishing and buffing shoes. The apparatus is comprised of a housing, the upper side of which is provided with a handle, and the lower side of which is provided with a channel through which the spindle of a rotary brush or buffing wheel may be inserted for releasable engagement. The housing encloses an electric motor and gear mechanism for driving said spindle. A releasing mechanism operable from a site adjacent the handle effects removal of the spindle when a change of the brush or buffing wheel is desired.

6 Claims, 5 Drawing Figures

HAND-HELD SHOE POLISHING APPARATUS

BACKGROUND OF THE INVENTION

This invention relates to apparatus for polishing shoes, and more particularly concerns shoe-polishing apparatus small enough in size to be readily held and manipulated by hand.

In the polishing of shoes, a waxy polish composition is usually applied to the polishable region of the outer surface of the upper portion of the shoe, and a buffing step is then conducted to cause the polish to produce a glossy finish. Mechanical devices earlier disclosed for the polishing of shoes utilize brushes rotated by an electric motor for both steps of applying the polish, and buffing. Such devices have been of cumbersome size and weight, and therefore not amenable to hand-held operation. There has also been a long-felt need for a shoe-polishing apparatus which can operatively accommodate different applicator brushes for polish compositions of different colors, and can hold a buffing wheel for producing a high-gloss finish. Such sought improvements in a shoe-polishing apparatus have not heretofore been achievable in a small apparatus having sufficient power to adequately drive the applicator brushes and buffing wheel.

It is accordingly an object of the present invention to provide apparatus of light weight and compact size for the polishing of shoes.

It is a further object of the invention to provide apparatus of the aforesaid nature capable of interchangeably holding brushes and buffing wheels.

It is another object of this invention to provide apparatus as in the foregoing object capable of rotating said brushes and buffing wheels with a force adequate to achieve the polishing of shoes.

It is a still further object of the present invention to provide an improved shoe-polishing apparatus of simple and rugged construction which may be economically manufactured.

These objects and other objects and advantages of the invention will be apparent from the following description.

SUMMARY OF THE INVENTION

The above and other beneficial objects and advantages are accomplished in accordance with the present invention by an improved polishing apparatus which comprises:

(a) an elongated housing comprised of interengaged upper and lower portions, (b) an elongated holding handle disposed above said upper housing portion and oriented substantially parallel to the direction of elongation of said housing, (c) an electric motor and associated drive shaft confined within said housing and oriented such that said drive shaft is substantially parallel to the direction of elongation of said housing, (d) a first gear associated with the distal extremity of said drive shaft, (e) a second gear positioned within said housing in operative engagement with said first gear and adapted to re-direct the torque of said drive shaft 90° in the direction of said lower housing portion, (f) a rotary shoe-polishing attachment comprised of a circular head and a spindle perpendicularly attached to the center of said head, said spindle having retention means and first coupling means associated therewith, (g) a channel in said lower housing portion adapted to accommodate the spindle of said rotary attachment, (h) second coupling means centrally associated with said second gear and adapted to releasably interengage the first coupling means of said spindle for transmitting torque thereto, (i) spring-restorable releasing means extending above said upper housing portion and adapted to disengage said spindle from said second gear, and (j) on-off electrical switch means to control the operation of said motor.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

Figure 1:
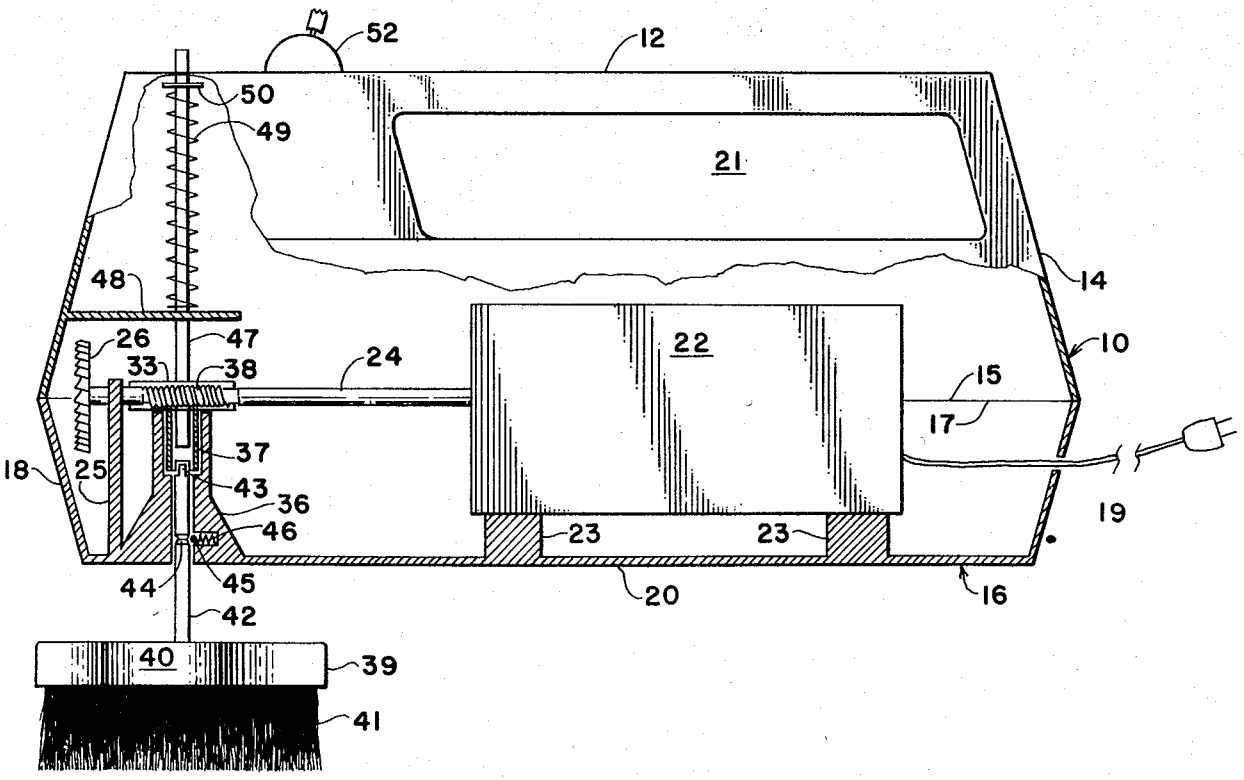
FIG. 1 is a side view of an embodiment of the apparatus of the present invention with portions broken away to reveal interior detail.

For convenience in description, the terms "front" or "forward" and "rear", or words of similar import, will have reference to the left and right ends, respectively, of the apparatus appearing in FIG. 1. The terms "upper", "lower" and equivalents thereof will have reference to the upper and lower regions, respectively, of the apparatus appearing in FIG. 1.

DESCRIPTION OF THE PREFERRED EMBODIMENT

Figure 2:
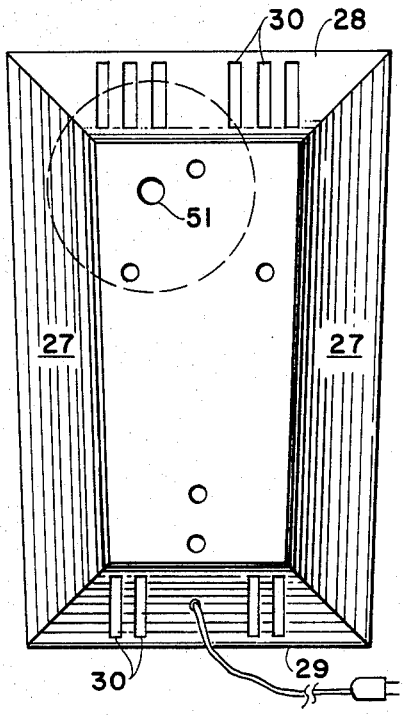
FIG. 2 is a bottom view of the apparatus of FIG. 1.

Referring to FIG. 1, an apparatus of the present invention is shown comprised of an elongated housing 10 comprised of an upper housing portion 11 bounded by handle 12, front end 13, rear end 14, and horizontal lower edge 15; and hull-shaped lower housing portion 16 bounded by horizontal upper edge 17, forward extremity 18, rearward extremity 19 and flat bottom surface 20 disposed in a plane parallel to upper edge 17. Both upper and lower portions are substantially shell-type structures fabricated preferably by injection molding from a thermoplastic resin such as acrylonitrile/-butadiene/styrene copolymer having high impact strength. Lower edge 15 and upper edge 17 are of substantially identical configuration and adapted for mating, thereby forming an enclosure which constitutes housing 10. Joinder of said upper and lower portions is preferably by way of threaded fasteners, thereby facilitating access to the interior of the apparatus. Handle 12, an integral member of upper portion 11 may be of hollow construction, and defines an opening 21 within upper portion 11 of adequate dimensions to accommodate the fingers of the user. The bottom of said lower housing portion, as best shown in FIG. 2, is provided with tapered sides 27, and tapered front and rear panels, 28 and 29 respectively. Slotted ventilation apertures 30 are located in said front and rear panels.

An electric motor 22 of fractional horsepower is supportively positioned within lower housing portion 16 by mounts 23 integral with said lower housing portion. A drive shaft 24 forwardly emerges from said motor. The drive shaft is rotatively supported adjacent its distal extremity by support post 25 upraised from the bottom of the housing and integral therewith. A fan blade 26 is affixed to said shaft and adapted to blow air past motor 22 and out ventilation apertures 30. A first, or worm gear 31 is affixed to shaft 24 adjacent the distal extremity thereof but before fan blade 26.

Figure 5:
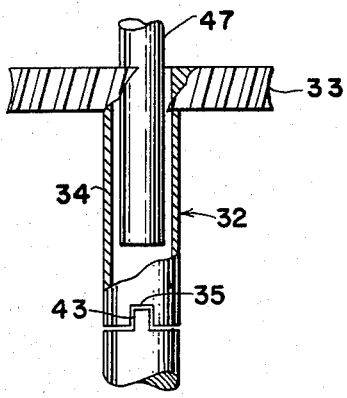
FIG. 5 is a side view of the drive member of the apparatus of FIG. 1 with portions broken away.
Figure 3:
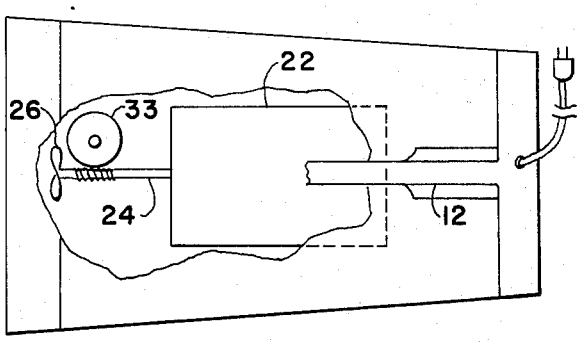
FIG. 3 is a top view of the apparatus of FIG. 1 with portions broken away to reveal interior detail.

A drive member 32, shown most clearly in FIG. 5, is comprised of a second, or circular gear 33 adapted to mesh with worm gear 31, and a hollow cylindrical stem 34 perpendicularly centered upon gear 33. The downwardly directed free extremity of stem 34 is provided with opposed aligned notches 35 which constitute second coupling means. Drive member 32 is rotatively supported by pedestal block 36 in a manner such that its stem is perpendicularly oriented to bottom surface 20, said rotative support being achieved by the close-fitting insertion of the stem into circular channel 37 in said pedestal block, and the abutment of the flat upper extremity 38 of pedestal block 36 with the lower flat surface of gear 33. Said pedestal block is preferably an integral extension of the lower portion of the housing.

Figure 4:
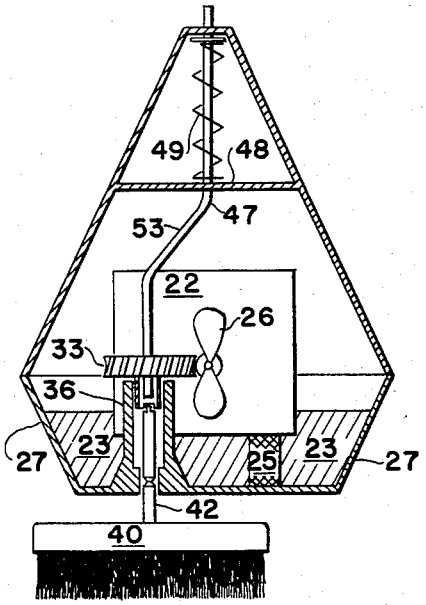
FIG. 4 is a front view of the apparatus of FIG. 1 with portions broken away.

A polishing brush assembly 39, as shown in FIGS. 1 and 4, is comprised of brush base 40 of circular configuration, bristles 41 emanating perpendicularly from base 40, and spindle 42 of cylindrical contour perpendicularly affixed to the upper surface of base 40 at the center thereof. The diameter of said spindle is such as to permit close-fitting passage through channel 37 of said pedestal block. The upper extremity of said spindle is provided with a protrusion 43 in the form of a screw-driver type tip which constitutes first coupling means adapted to engage the notches 35 of the extremity of stem 34. An annular detent groove 44 on said spindle functions as retaining means adapted to interact with bearing 45 forwardly urged by spring 46 housed within pedestal block 36.

An ejector rod 47 extends perpendicularly through an aperture in the top of the housing in front of handle 12. The lower extremity of said ejector rod is adapted to fit within stem 34 of drive member 32. The position of the ejector rod is stabilized by sliding penetration through a close-fitting aperture in holding tab 48 integral with the upper housing portion. A coil spring 49, positioned upon rod 47, extends between holding tab 48 and collar 50 affixed to said rod. The arrangement of the spring is such that ejector rod 47 may be pressed downwardly against the force of the spring. Upon release of downward pressure, the upper extremity of rod 47 will return to its original elevation above the housing. Because the upper extremity of rod 47 is centered above the housing, and its lower extremity enters stem 34 which is displaced from the center of the apparatus, upper and lower extremities of said rod are misaligned by way of offset 53 shown in FIG. 4.

In operation, the spindle of a polishing brush is inserted through aperture 51 in the underside of the housing, said aperture representing the lower extremity of channel 37 of said pedestal block. The spindle is inserted to its seating position wherein protrusion 43 engages notches 35 of stem 34, and spring urged bearing 45 engages detent groove 44 of said spindle. In such seated position, the brush is rotated by virtue of its coupling to drive member 32 which is turned by motor driven worm gear 31. The interactive effect of bearing 45 with detent groove 44 is to provide holding means which permit easy mounting and removal of a polishing brush or buffing wheel, said buffing wheel being similar in construction to a polishing brush except that a soft fibrous material is associated with base 40 instead of the bristles. Removal of a mounted polishing brush or buffing wheel is achieved by depression of ejector rod 47. Other equivalent coupling means may be utilized to cause the spindle to be driven by the drive member, and other equivalent retention means may be utilized to maintain the spindle rotatively positioned within the housing.

For convenience of operation an on-off switch 52 may be located atop the housing adjacent handle 12 for control of electrical current delivered through conductor cord 54 for the operation of motor 22. Although specific holding and positioning means have been exemplified for locating the various interactive components within the housing, it is to be understood that alternative equivalent embodiments of such holding and positioning means are contemplated within the purview of this invention.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described the invention, what is claimed is:

1. A hand-holdable apparatus for polishing and buffing shoes comprising:

(a) a housing elongated between front and rear extremities and comprised of interengaged upper portion and lower portion provided with ventillation apertures, (b) an elongated holding handle disposed above said upper housing portion and oriented substantially parallel to the direction of elongation of said housing, (c) an electric motor and associated drive shaft confined within said housing and oriented such that said drive shaft is substantially parallel to the direction of elongation of said housing and terminates in a distal extremity directed toward the front of said housing, said distal extremity having attached thereto a fan blade adapted to force air past said motor and out said ventillation apertures, (d) a worm gear associated with said drive shaft in coaxial disposition therewith, (e) a second gear positioned within said housing in operative engagement with said worm gear and adapted to re-direct the torque of said drive shaft 90° in the direction of said lower housing portion.

(f) a rotary shoe-polishing attachment comprised of a circular head and a spindle perpendicularly attached to the center of said head, said spindle having retention means and first coupling means associated with the upper extremity of said spindle, (g) a channel in said lower housing portion adapted to accommodate the spindle of said rotary attachment, (h) second coupling means centrally associated with said second gear and adapted to releasably interengage the first coupling means of said spindle for transmitting torque thereto, (i) spring-restorable releasing means having an upper extremity extending above said upper housing portion, and a lower extremity positioned within said housing, said upper and lower extremities being misaligned by way of an offset portion, said releasing means being adapted to disengage said spindle from said second gear, (j) electrical switch means to control the operation of said motor, located adjacent said holding handle, and (k) an electrical supply cord.

2. The apparatus of claim 1 wherein said upper and lower portions comprising said housing are substantially shell-type structures fabricated by injection molding from a thermoplastic resin having high impact strength.

3. The apparatus of claim 2 wherein said upper and lower portions are joined by threaded fasteners.

4. The apparatus of claim 2 wherein said handle is integral with said upper portion, and defines an opening within said upper portion of adequate dimensions to accommodate the fingers of the user.

5. The apparatus of claim 2 wherein said second gear has perpendicularly associated therewith a hollow cylindrical stem which is coaxially aligned with the channel in said lower housing.

6. The apparatus of claim 5 wherein the lower extremity of said releasing means resides within said hollow cylindrical stem and is adapted to press downwardly upon the upper extremity of said spindle.

* * * * *